US010722033B1

(12) United States Patent
Chen

(10) Patent No.: US 10,722,033 B1
(45) Date of Patent: Jul. 28, 2020

(54) BATHING SEAT STRUCTURE FOR USE IN A BATHTUB

(71) Applicant: Jui-Hsiao Chen, Taichung (TW)

(72) Inventor: Jui-Hsiao Chen, Taichung (TW)

( * ) Notice: Subject to any disclaimer, the term of this patent is extended or adjusted under 35 U.S.C. 154(b) by 3 days.

(21) Appl. No.: 16/364,922

(22) Filed: Mar. 26, 2019

(51) Int. Cl.
*A47C 3/18* (2006.01)

(52) U.S. Cl.
CPC ..... *A47C 3/18* (2013.01)

(58) Field of Classification Search
None
See application file for complete search history.

(56) References Cited

U.S. PATENT DOCUMENTS 4,359,791 A * 11/1982 Thomas ..... A47K 3/122 248/430
4,391,006 A * 7/1983 Smith ..... A47K 3/122 4/559
4,472,844 A * 9/1984 Mace ..... A47K 3/122 4/579
5,903,935 A * 5/1999 Huelke ..... A47K 3/122 4/560.1
5,940,905 A * 8/1999 Cheng ..... A47K 3/122 4/560.1
6,088,847 A * 7/2000 Burrow ..... A47K 3/122 297/344.24
6,256,806 B1 * 7/2001 DiTommaso ..... A47K 3/122 4/560.1
6,681,415 B1 * 1/2004 Gallo ..... A47K 3/122 297/423.3
7,451,501 B2 * 11/2008 Cheng ..... A47K 3/122 4/560.1
7,661,154 B2 * 2/2010 Cheng ..... A47K 3/122 4/560.1
9,138,063 B1 * 9/2015 Newman ..... A47C 15/008
10,542,848 B1 * 1/2020 Lin ..... A47K 3/122
2008/0148473 A1 * 6/2008 Cheng ..... A61G 7/1059 4/578.1
2011/0304187 A1 * 12/2011 Ross ..... A47C 1/14 297/344.24
2013/0205491 A1 * 8/2013 Edwards ..... A47K 3/003 4/560.1
2016/0058192 A1 * 3/2016 Drew ..... A47C 9/10 297/4
2017/0172353 A1 * 6/2017 Chao ..... F16B 12/26
(Continued)

*Primary Examiner* — David R Dunn
*Assistant Examiner* — Christopher E Veraa
(74) *Attorney, Agent, or Firm* — Muncy, Geissler, Olds & Lowe, P.C.

(57) ABSTRACT

The present invention provides a bathing seat structure for use in a bathtub, wherein the legs frame enables fixed positioning of the base, and the base enables fixed positioning of the seat cushion. The base is provided with two freeing mechanisms, a lever, and a rolling device. After pulling open the lever, the rolling device enables the seat cushion to rotate. The two freeing mechanisms must be pressed to a predetermined depth and must be pressed simultaneously, only then can the seat cushion be shifted laterally, thus preventing inadvertent contact and causing displacement of the seat cushion. The rolling device uses a two-tier centrifugal configuration, thereby supporting equal distribution of a person's weight to achieve smooth rotation with no inclining of the seat cushion, and thus extending the serviceable life of the rolling device.

6 Claims, 11 Drawing Sheets

(56) References Cited

U.S. PATENT DOCUMENTS

| | | | | |
|---|---|---|---|---|
| 2017/0367540 | A1* | 12/2017 | Chang | A47K 3/122 |
| 2018/0311098 | A1* | 11/2018 | Kelsey | A47C 3/18 |
| 2020/0015635 | A1* | 1/2020 | Racanelli | A47K 3/122 |

* cited by examiner

BATHING SEAT STRUCTURE FOR USE IN A BATHTUB

BACKGROUND OF THE INVENTION

(a) Field of the Invention

The present invention relates to a bathing seat structure for use in a bathtub, and more particularly to a bathing seat structure for use in a bathtub that uses freeing mechanisms that must be pressed to a predetermined depth; moreover, the two freeing mechanisms must be pressed simultaneously, only then can a seat cushion be shifted laterally, thus preventing inadvertent contact and causing easy displacement of the seat cushion. A rolling device uses a two-tier configuration of upper rollers and lower rollers, wherein the upper rollers and the lower rollers are respectively configured at a distance from a pivot connecting centre, thereby supporting equal distribution of a person's weight to achieve smooth rotation with no inclining of the seat cushion, and thus extending the serviceable life of the rolling device.

(b) Description of the Prior Art

The main functions of conventional bathing seat structures for use in a bathtub of the prior art enable a physically challenged person to sit thereon and allow a caregiver to bathe the person, with the bathing seat disposed so as to traverse a bathtub. The bathing seat is fitted with a legs frame or supporting frame to serve as a frame for fixed positioning on the bathtub. The bathing seat also comprises a rotatable seat cushion and a base able to shift laterally. The seat cushion is mounted on the base, and the base is further mounted on the legs frame, thus, a physically challenged person can be shifted laterally by means of the base and rotated by means of the seat cushion, thereby facilitating a caregiver in assisting the person to bathe without needing to bodily move the physically challenged person, therefore eliminating the need to for great effort and preventing injury to the physically challenged person.

However, the seat cushion and the base of conventional bathing seats for use in a bathtub only use a single layer of roller members, which are concentrated on a central pivot area, which easily results in uneven inclination of the seat cushion and heavy wear on the roller members. Hence, the conventional bathing seats have the shortcoming of hindered motion of the seat cushion. In addition, the base is mounted on the legs frame using a fastening device, with some of the fastening devices using a rotating handle as the fastening operation, and some using a traction device to free the fastening device. Accordingly, the fastening device is inconvenient for the caregiver with regard to operation thereof, and has further shortcomings such as the rotating handle being frequently unwittingly touched, thereby loosening the fastening device, whereas the traction device easily traps the fingers.

SUMMARY OF THE INVENTION

Accordingly, conventional bathing seats for use in a bathtub easily result in uneven inclination of the seat cushion and heavy wear on the roller members, and thus have the shortcoming of hindered motion of the seat cushion. Moreover, operation of the fastening device is inconvenient and causes distress for an invalid's caregiver.

Hence, a bathing seat structure for use in a bathtub of the present invention comprises:

A legs frame, which is assembled from a plurality of bars and can be placed within a bathtub or disposed so as to traverse a bathtub. The legs frame is fitted with two top cross bars, which are provided with a plurality of positioning holes, and spring members and positioning plugs are disposed within each of the top cross bars, wherein the positioning plugs protrude external of the positioning holes.

A base, which comprises an upper plate and a lower plate; the lower plate is pin connected to the legs frame, and the bottom portion of the lower plate is provided with a plurality of pin connecting tubes that are mounted on the exterior of the top cross bars, wherein the two front-end pin connecting tubes are respectively configured with a freeing mechanism. The upper plate is joined to the seat cushion, and a rolling device is fitted between the upper plate and the lower plate. The upper plate is provided with an upper through hole, and the lower plate is provided with a lower through hole. The upper plate is fitted with a lever, which is provided with a spring and a clasp post, wherein the clasp post inserts into the upper through hole and the lower through hole.

A seat cushion, which is joined to the upper plate of the base, and the bottom portion of the seat cushion is fixedly positioned with a bolt that enables mounting a spring thereon.

The present invention is characterized in that: each of the freeing mechanisms comprises a press button, a spring, and a stud bolt, wherein the press button is provided with a press column, the spring is mounted on the press column, and the stud bolt combines internally with the press column. Each of the pin connecting tubes is externally configured with a protruding body, which is internally provided with a through hole. The through hole is internally provided with an inner push edge and an outer push edge. The stud bolt is provided with a bolt head; the inner push edge stops the bolt head of the stud bolt when externally pushed thereon, and the outer push edge enables fixed positioning of a plug cap. The plug cap is internally provided with an inner push ring and an internal through hole, wherein the spring butts atop the inner push ring and the internal through hole enables the stud bolt to pass therethrough. Pressing down on the press button connectively drives the stud bolt and the bolt head, whereupon the bolt head pushes atop and causes the positioning plug to retract from within the positioning hole, which is thus subjected to the natural restoring force of the spring. The rolling device comprises a plurality of upper rollers, a circular plate, and a plurality of lower rollers. The bottom surface of the upper plate is provided with a plurality of bottom positioning slots, and the upper rollers are disposed in the bottom positioning slots. The top surface of the lower plate is provided with a plurality of top positioning slots, and the lower rollers are disposed in the top positioning slots. The circular plate is centrally pivot connected between the upper plate and the lower plate, and pulling the lever causes the clasp post to separate from the upper through hole. The base is internally provided with a two-tier configuration of the upper rollers and the lower rollers, wherein the upper rollers and the lower rollers are spread around the centre of the circular plate, thereby enabling smooth rotation on the lower plate of the base.

The primary object of the present invention lies in providing an operation of the two freeing mechanisms which must be pressed to a predetermined depth; moreover, the two freeing mechanisms must be pressed simultaneously, only then can the seat cushion be shifted laterally, thereby preventing inadvertent touching and easily causing displacement of the seat cushion.

A second object of the present invention lies in providing the rolling device with a two-tier configuration of the upper rollers and the lower rollers, wherein the upper rollers and the lower rollers are configured at a distance from a pivot connecting centre, thus supporting equal distribution of a person's weight to achieve smooth rotation with no inclining of the seat cushion, thus extending the serviceable life of the rolling device.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
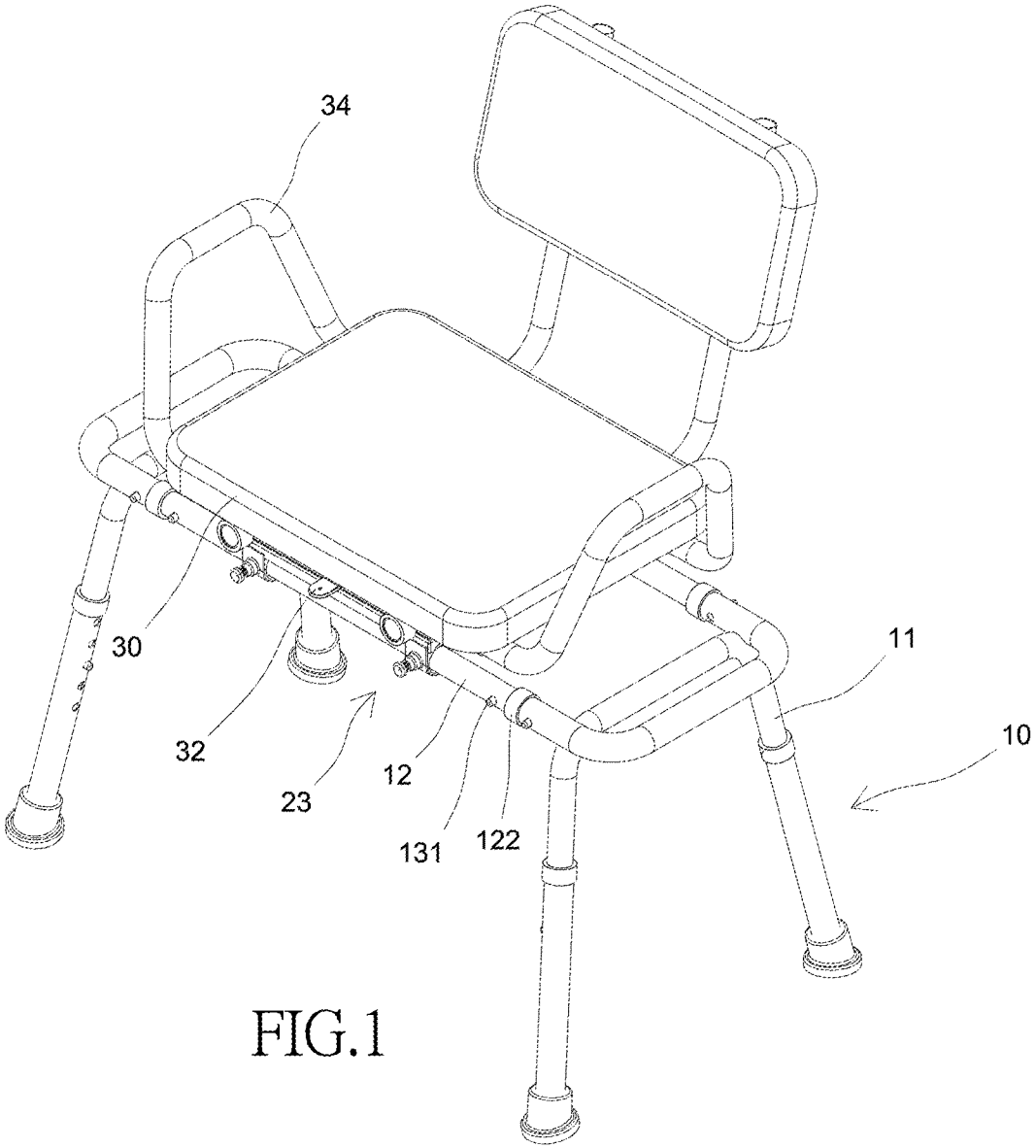
FIG. 1 is a three-dimensional schematic view of the present invention.
Figure 2:
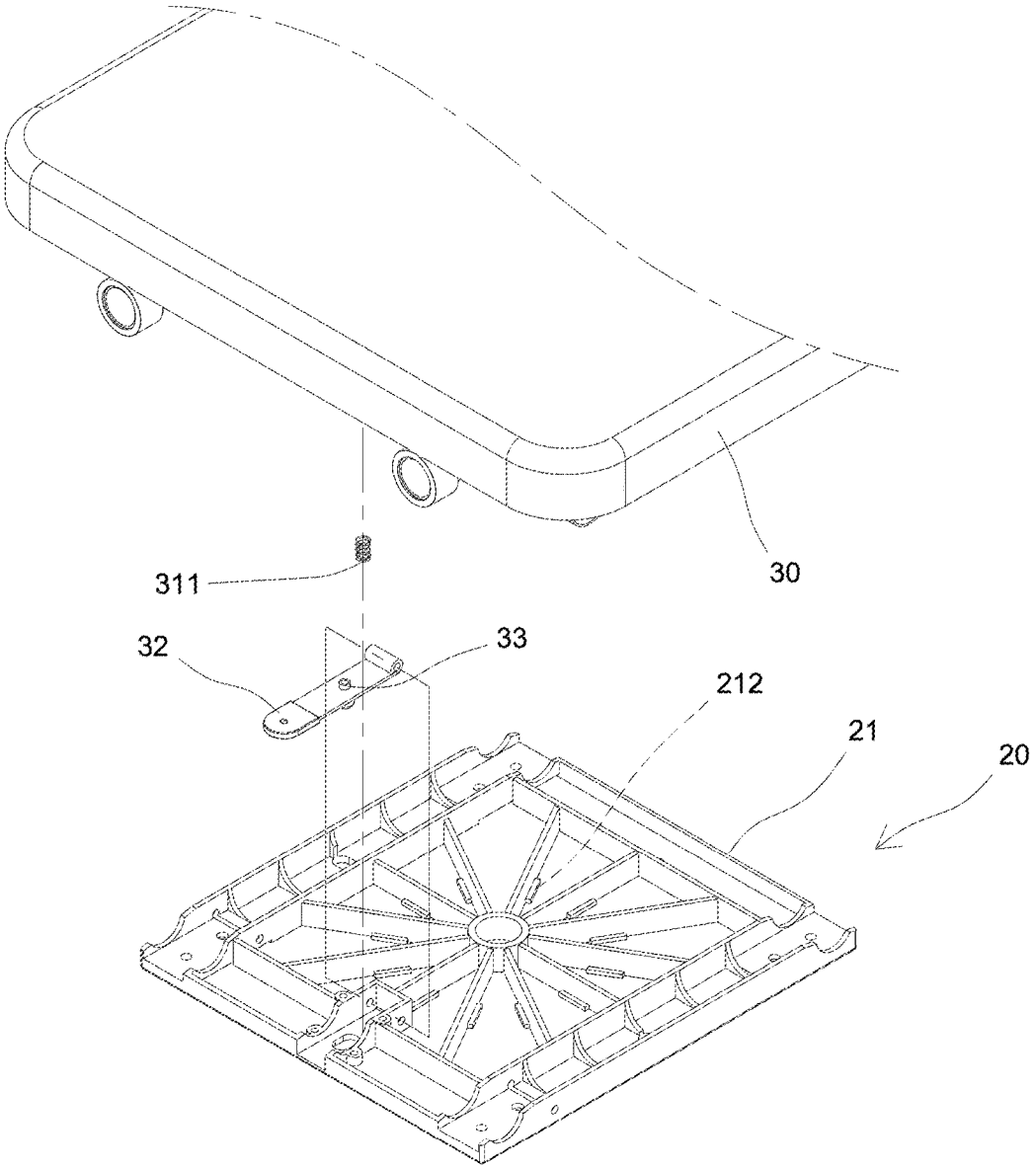
FIG. 2 is an exploded three-dimensional schematic view showing a portion of a seat cushion and an upper plate of the present invention.
Figure 3:
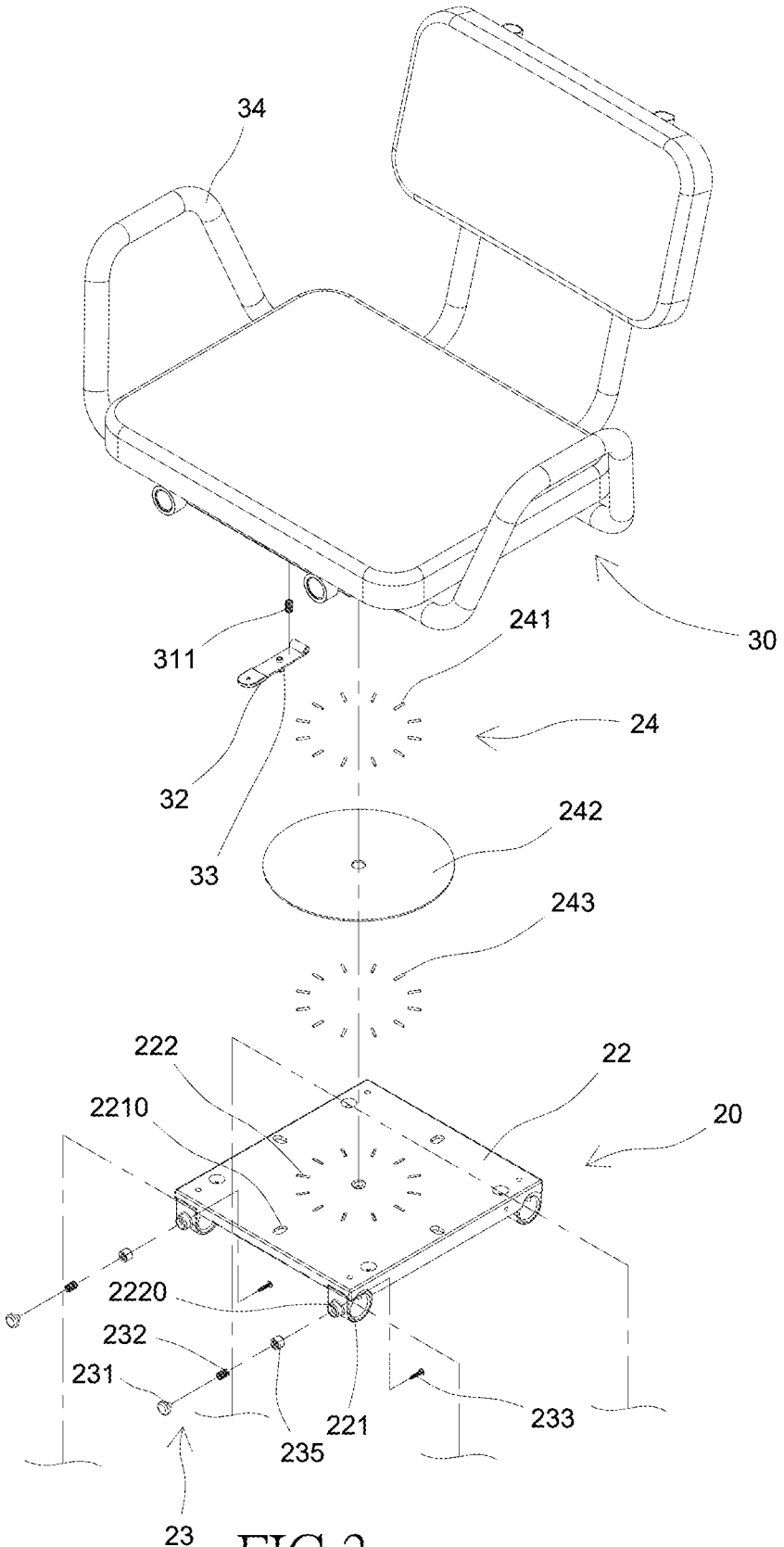
FIG. 3 is an exploded three-dimensional schematic view showing the seat cushion, a rolling device, and a lower plate of the present invention.
Figure 4:
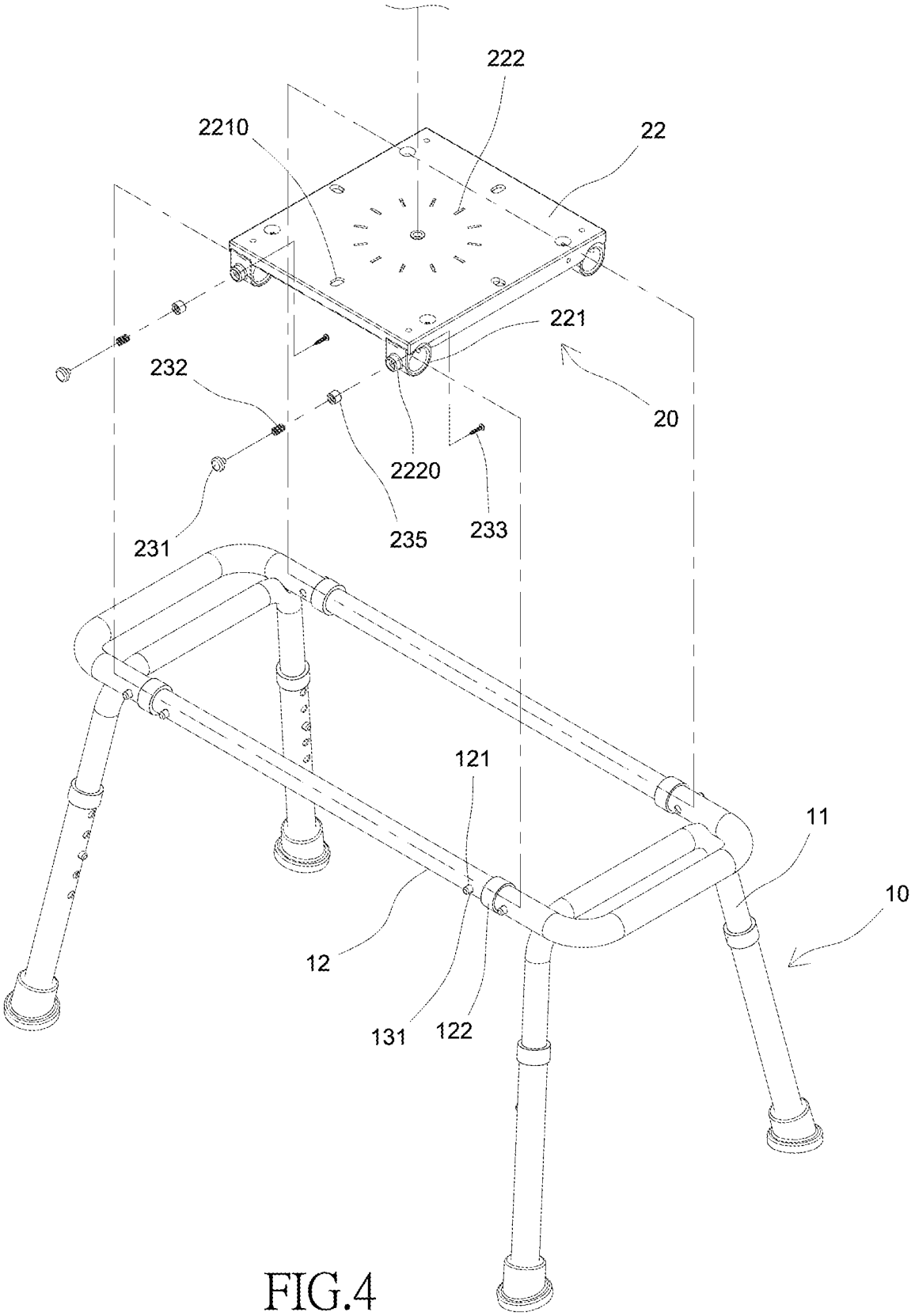
FIG. 4 is an exploded three-dimensional schematic view showing the lower plate and a legs frame of the present invention.
Figure 5:
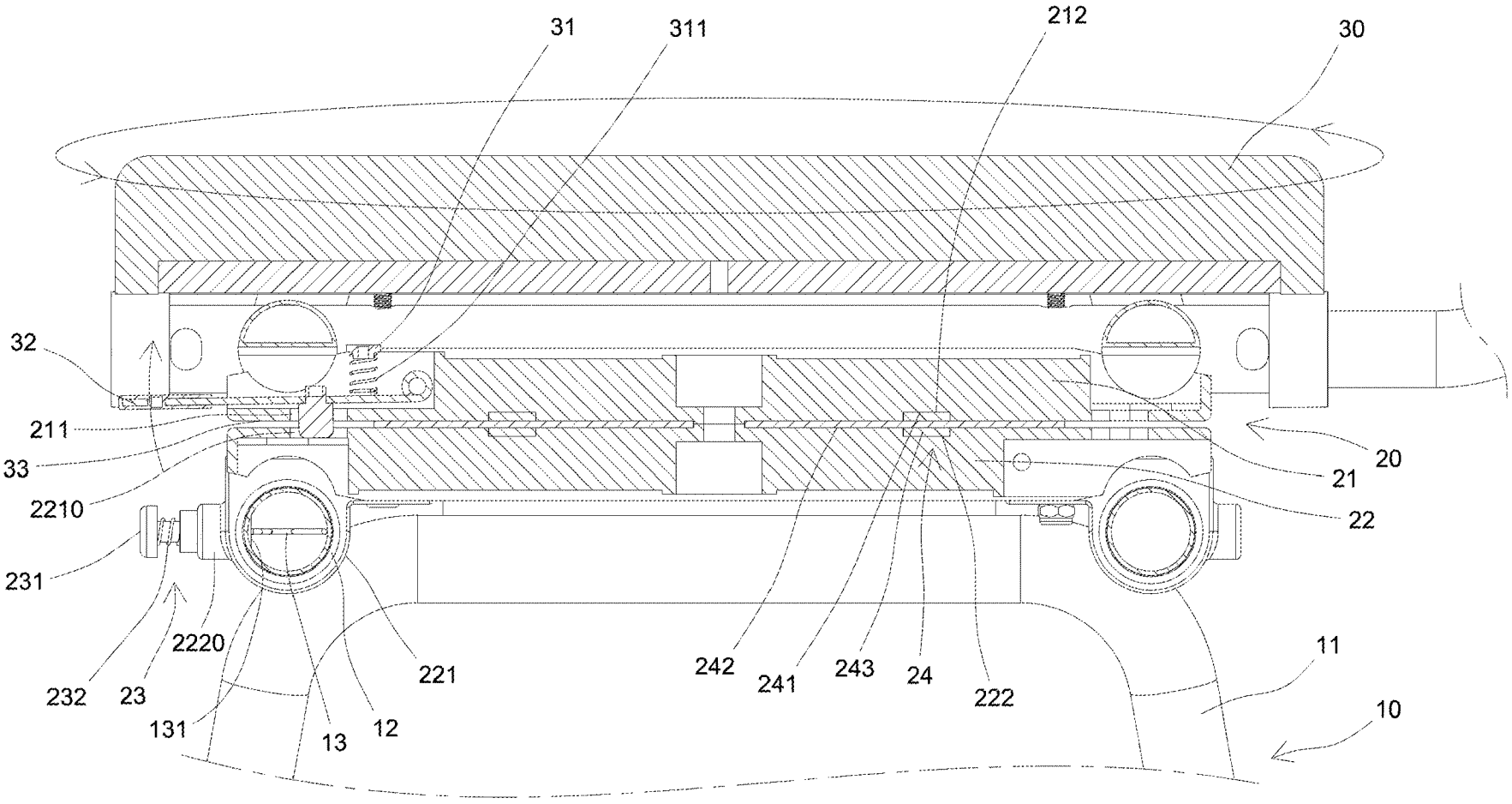
FIG. 5 is a cross-sectional schematic view of the seat cushion and a base of the present invention.
Figure 6:
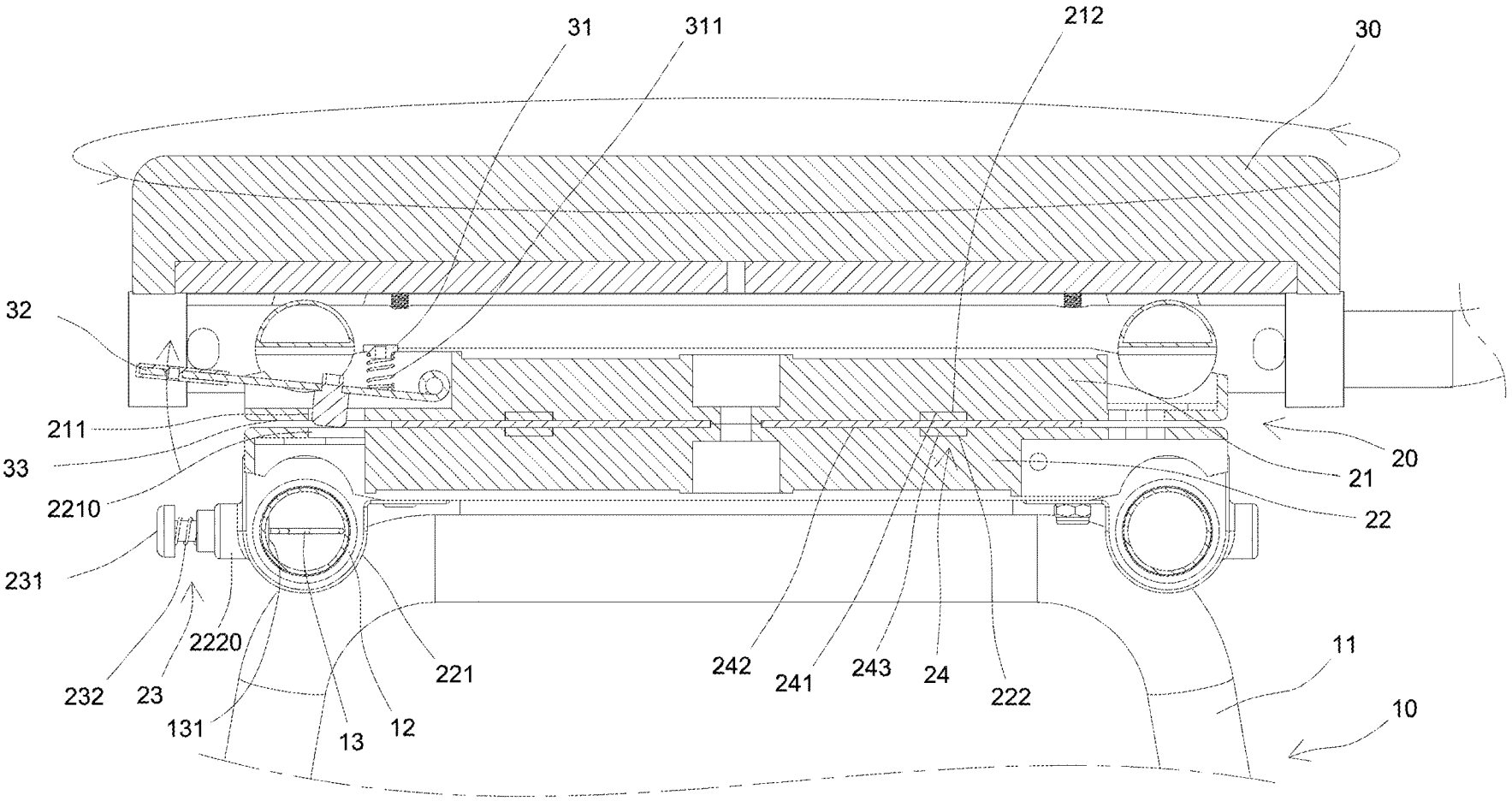
FIG. 6 is a cross-sectional schematic view depicting opening a lever by pulling to separate from a lower through hole according to the present invention.
Figure 7:
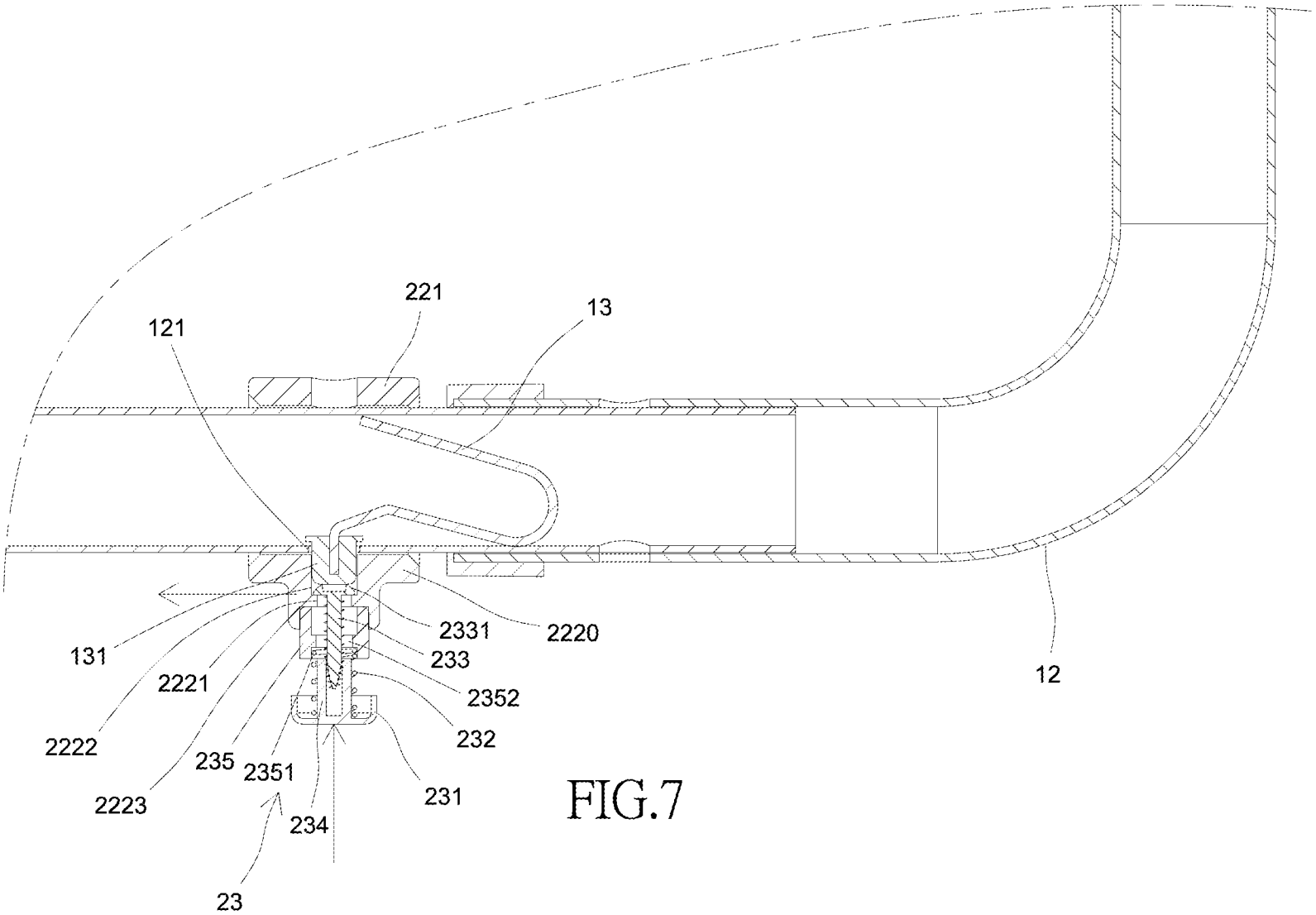
FIG. 7 is a cross-sectional schematic view of a freeing mechanism of the present invention.

Referring to FIGS. 1 to 5 and 7, which show the present invention comprising a legs frame 10, a base 20, and a seat cushion 30, wherein the legs frame 10 is assembled from a plurality of bars 11 and can be placed within a bathtub or disposed so as to traverse a bathtub. Two top cross bars 12 are fitted to the legs frame 10 (forming a top frame as shown in FIG. 4), and each of the top cross bars 12 is provided with a plurality of positioning holes 121 and two stop external rings 122. Spring members 13 and positioning plugs 131 are respectively configured within the top cross bars 12 (see FIG. 7), wherein the positioning plugs 131 protrude external of the positioning holes 121. The base 20 comprises an upper plate 21 and a lower plate 22 (see FIGS. 2, 3, 5), wherein the upper plate 21 is joined to the bottom portion of the seat cushion 30, and the bottom portion of the seat cushion 30 is fixedly positioned by means of a bolt 31, which enables mounting a spring 311 thereon. The lower plate 22 is pin connected to the legs frame 10, and the bottom portion of the lower plate 22 is fitted with four pin connecting tubes 221 that are used to mount the lower plate 22 on the top cross bars 12, thereby enabling displacement of the lower plate 22 on the two top cross bars 12 on top of the legs frame 10. The two ends of each of the top cross bars 12 are respectively configured with the stop external rings 122, which enable stopping displacement of the pin connecting tubes 221 of the lower plate 22. The two front-end pin connecting tubes 221 are each configured with a freeing mechanism 23 (see FIGS. 3 and 7), wherein the freeing mechanism 23 comprises a press button 231, a spring 232, and a stud bolt 233. The press button 231 is provided with a press column 234, and the spring 232 is mounted thereon. The stud bolt 233 combines internally with the press column 234, and each of the pin connecting tubes 221 is externally configured with a protruding body 2220, which is internally provided with a through hole 2221. The through hole 2221 is internally provided with an inner push edge 2222 and an outer push edge 2223. The stud bolt 233 is provided with a bolt head 2331, the inner push edge 2222 stops the bolt head 2331 of the stud bolt 233 when externally pushed thereon, and the outer push edge 2223 enables fixed positioning of a plug cap 235. The plug cap 235 is internally provided with an inner push ring 2351 and an internal through hole 2352, wherein the spring 232 butts atop the inner push ring 2351 and the internal through hole 2352 enables the stud bolt 233 to pass therethrough. Pressing down on the press button 231 connectively drives the stud bolt 233 and the bolt head 2331, whereupon the bolt head 2331 pushes atop and causes the positioning plug 131 to retract from within the positioning hole 121. Hence, apart from the natural restoring force of the spring 232, the spring member 13 within the top cross bar 12 also pushes on top of the positioning plug 131 and outwardly displaces the stud bolt 233, which restores the press button 231 to its original position. In addition, the lower portions on two sides of the seat cushion 30 are each fitted with an armrest bar 34.

Referring to FIGS. 2, 3, 5, 6 and 7, which show a rolling device 24 fitted between the upper plate 21 of the base 20 and the lower plate 22, wherein the upper plate 21 is provided with an upper through hole 211, and the lower plate 22 is provided with four lower through holes 2210 (which are respectively set at a ninety degrees angle to the four sides). The upper plate 21 is provided with a lever 32 that is fitted with a clasp post 33, and the lever 32 butts against the spring 311 at the bottom portion of the seat cushion 30. The clasp post 33 inserts into the upper through hole 211 and the lower through hole 2210. The rolling device 24 comprises a plurality of upper rollers 241, a circular plate 242, and a plurality of lower rollers 243. The bottom surface of the upper plate 21 is provided with a plurality of bottom positioning slots 212, and the upper rollers 241 are respectively disposed in the bottom positioning slots 212. The top surface of the lower plate 22 is provided with a plurality of top positioning slots 222, and the lower rollers 243 are disposed in the top positioning slots 222. The circular plate 242 is centrally pivot connected between the upper plate 21 and the lower plate 22, and pulling the lever 32 causes the clasp post 33 to separate from the lower through hole 2210. The two-tier configuration of the upper rollers 241 and the lower rollers 243 is configured within the base 20 and enables smooth rotation of the seat cushion 30 on the lower plate 22 of the base 20.

Figure 10:
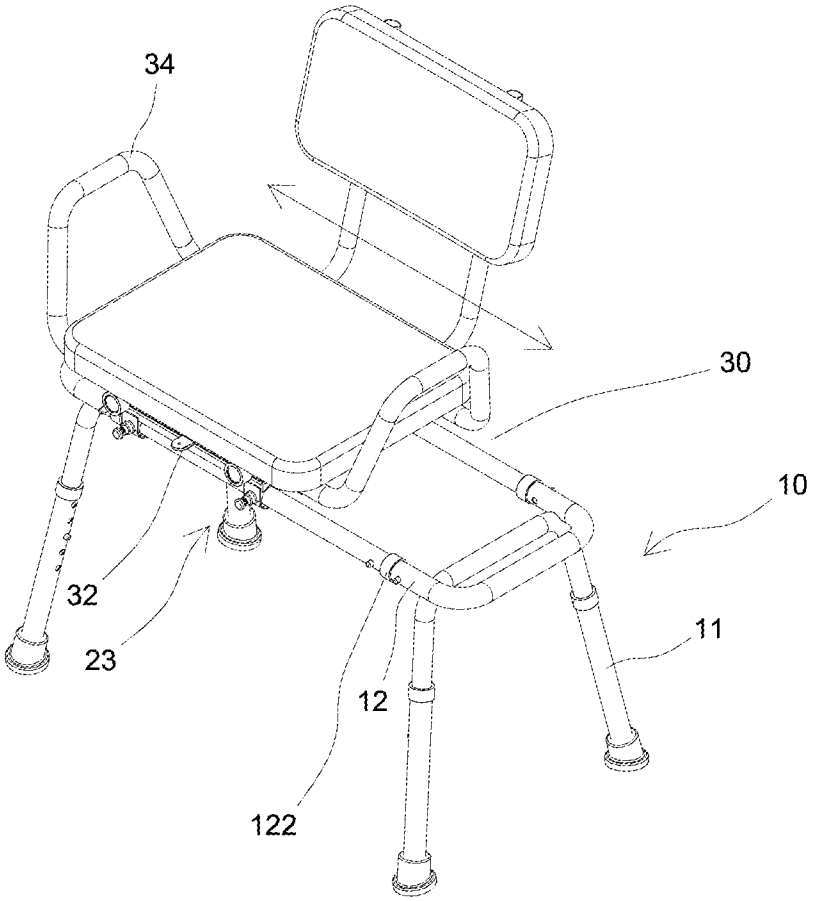
FIG. 10 is a three-dimensional schematic view showing left lateral displacement of the seat cushion on the legs frame according to the present invention.
Figure 9:
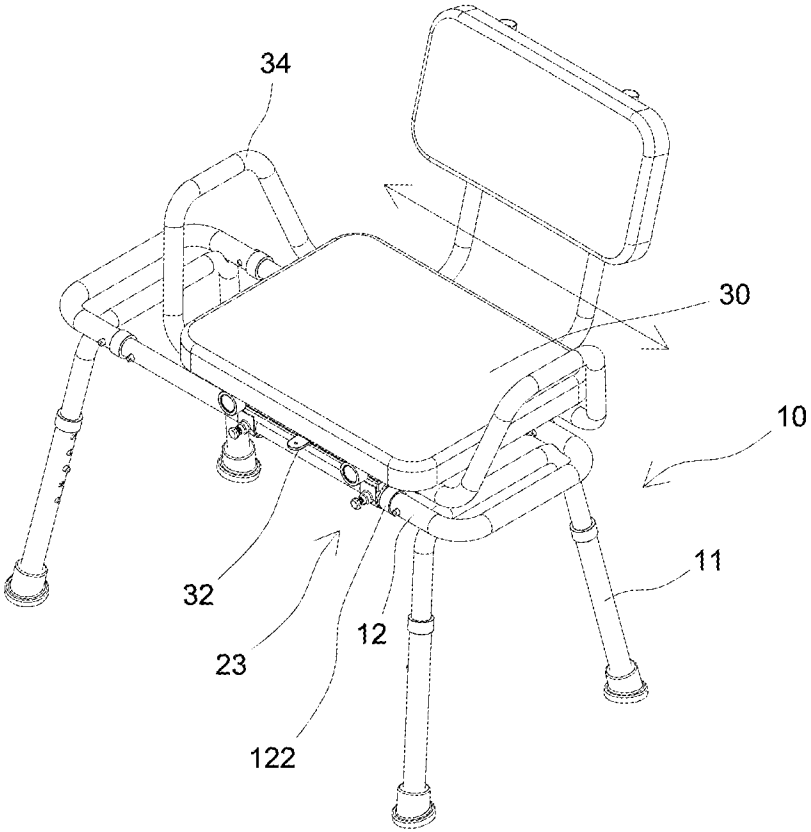
FIG. 9 is a three-dimensional schematic view showing right lateral displacement of the seat cushion on the legs frame according to the present invention.

According to the above-described improved structure of the bathing seat structure for use in a bathtub of the present invention, during operation, the bars 11 of the legs frame 10 are placed inside a bathtub or disposed so as to traverse a bathtub, enabling level placement of the bathing seat in or on a bathtub. A person can sit on the seat cushion 30, and a caregiver can laterally displace or rotate the seat cushion 30 according to actual needs. To enable lateral displacement of the seat cushion 30, the press buttons 231 are first concurrently pressed, which connectively drive the respective stud bolts 233 and the bolt heads 2331, whereupon the bolt heads 2331 push and cause the respective positioning plugs 131 to retract from within the positioning holes 121. At which time, the positioning plugs 131 are not wedged in the through holes 2221 of the pin connecting tubes 221 and the seat cushion 30 can be laterally displaced a distance on the top cross bars 12 of the legs frame 10. Re-pressing the press buttons 231 causes the positioning plugs 131 to again retract, enabling the seat cushion 30 to be laterally displaced until the pin connecting tubes 221 contact the respective stop external rings 122, which stops further displacement of the seat cushion 30 (see FIGS. 9, 10), whereupon the positioning plugs 131 spring back and again become wedged inside the respective through holes 2221 within the protruding bodies 2220, thereby causing the seat cushion 30 to be fixedly positioned once more, assuring safety and preventing inadvertent sliding.

Figure 8:
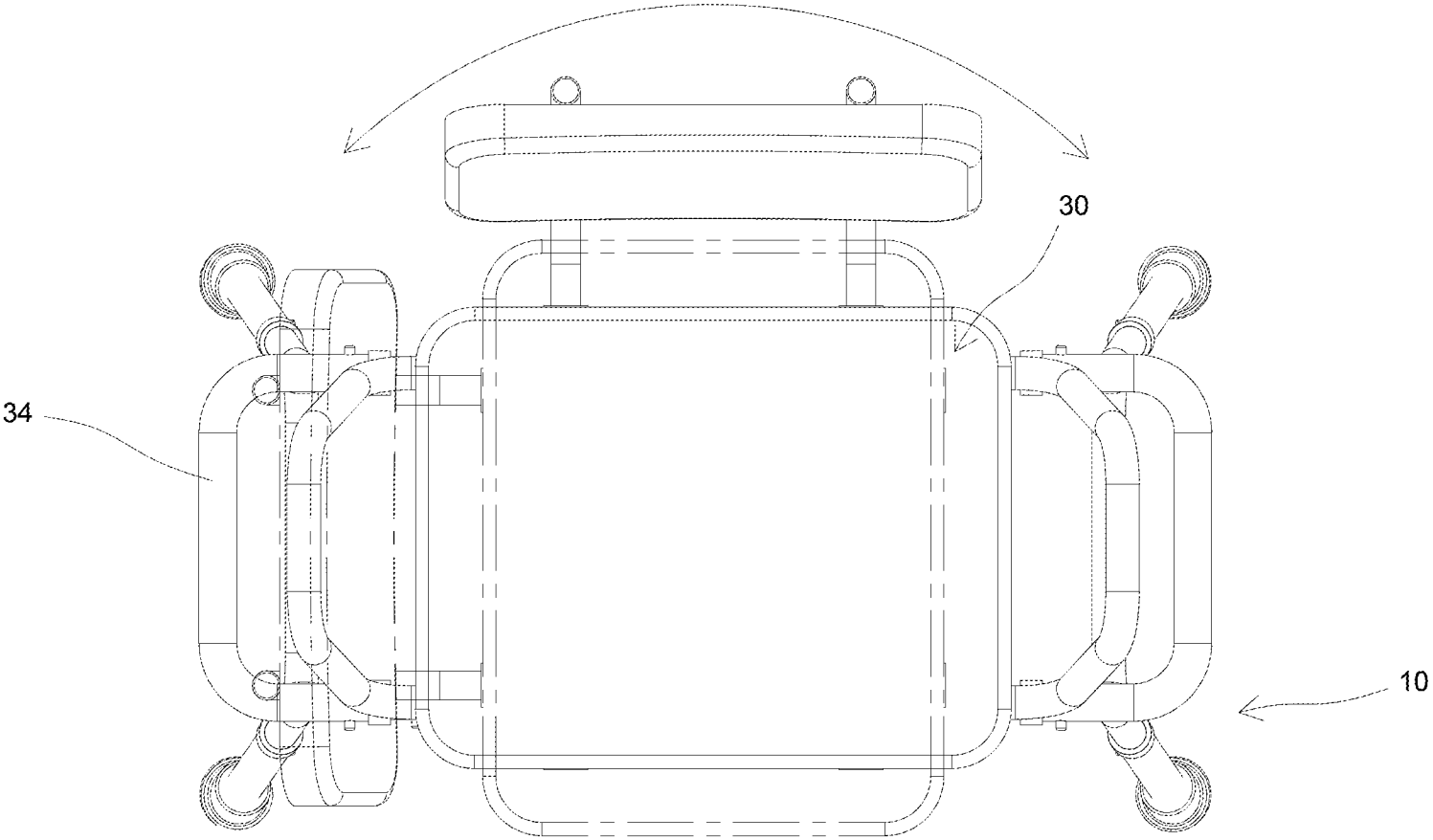
FIG. 8 is a plane schematic view depicting rotational movement of the seat cushion according to the present invention.

If the bathing seat needs to be rotated, the lever 32 is pulled open (see FIG. 6), which connectively causes and upwardly separates the clasp post 33 from the lower through hole 2210, and because the upper plate 21 is fixed to the seat cushion 30, the seat cushion 30 is able to rotate through ninety degrees, 180 degrees, or 270 degrees on the upper portion of the lower plate 22 by means of the rolling device 24 (see FIG. 8). Releasing the lever 32 causes the clasp post 33 to downwardly insert into the lower through hole 2210, thereby fixed positioning both the lower plate 22 and the upper plate 21 and correspondingly fixed positioning the seat cushion 30 at one of the specified angles, thus meeting actual needs of a caregiver and facilitating bathing the front, side, or back of an invalid.

Figure 11:
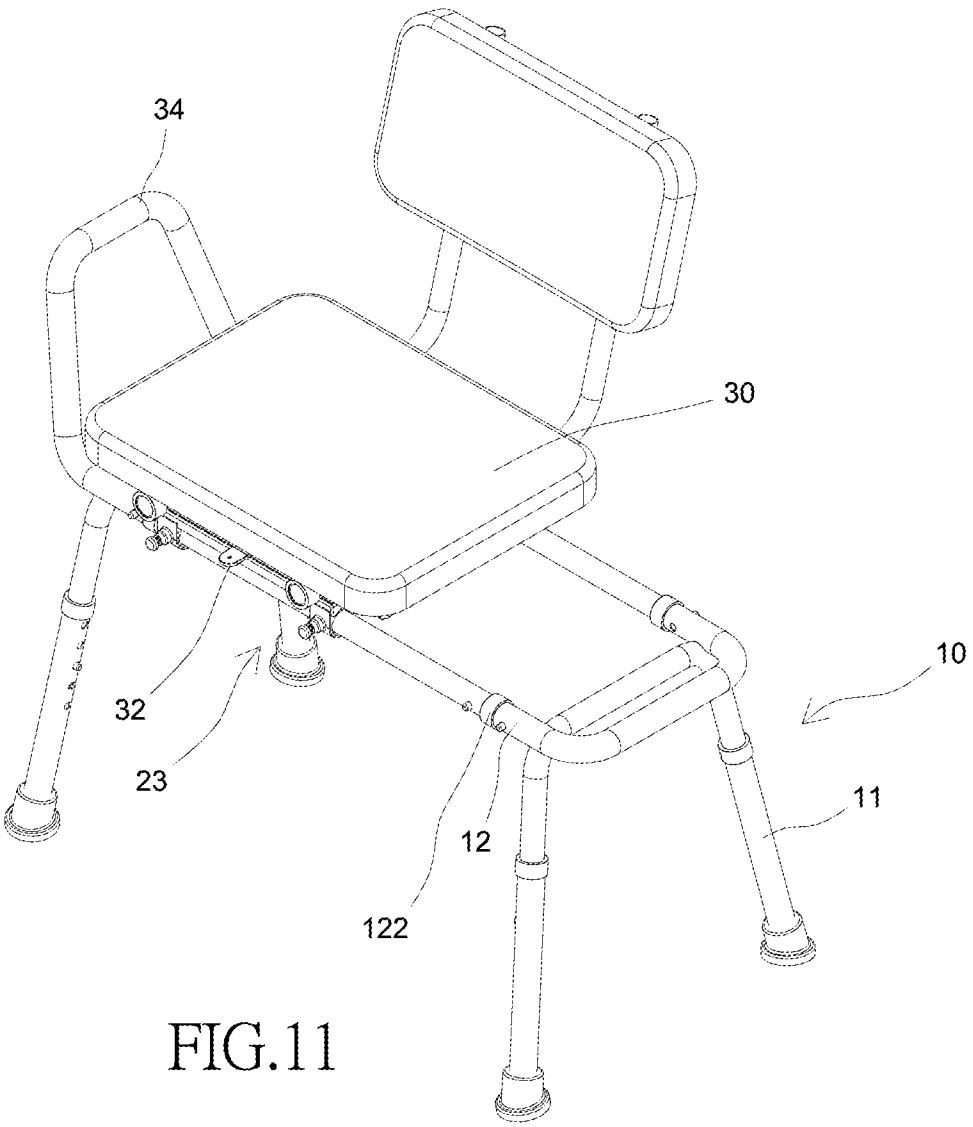
FIG. 11 is a three-dimensional schematic view showing the present invention with only a single armrest bar.
Figure 12:
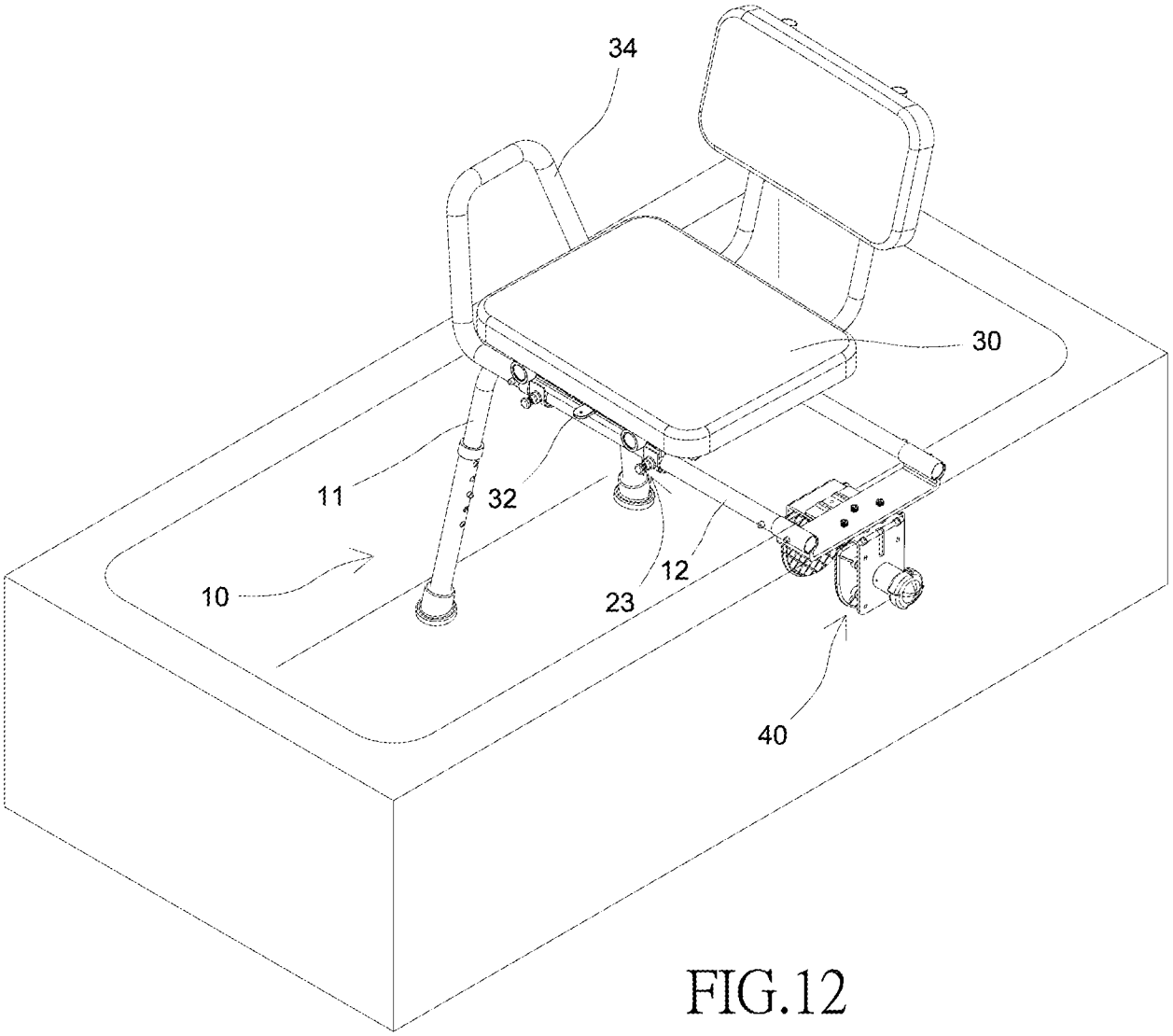
FIG. 12 is a three-dimensional schematic view showing the present invention with only a single armrest bar, the legs frame with only a pair of legs on one side thereof, and a clamping device clamped onto a bathtub.

Referring to FIG. 11, which shows a lower portion on only one side of the seat cushion 30 fitted with the single armrest bar 34, which is facilitates in and out and displacement of an invalid. Referring to FIG. 12, which shows the bathing seat with the legs frame 10 with only a pair of legs on one side thereof and a clamping device 40 fitted on the legs frame 10 opposite the single armrest bar 34. The clamping device 40, which is able to clamp onto a bathtub, belongs to well-known technology in the art, and thus not further detailed herein.

The present invention primarily provides the pin connecting tubes 221 respectively configured with a freeing mechanism 23 which adopts a pressing method. Moreover, the two freeing mechanisms 23 need to be concurrently pressed to a predetermined depth and must be concurrently moved, only then can the seat cushion 30 be shifted sideways, thereby preventing inadvertently touching the freeing mechanisms 23 and easily causing displacement of the seat cushion 30. Furthermore, the present invention uses the two-tier configuration of the upper rollers 241 and the lower rollers 243, wherein the upper rollers 241 and the lower rollers 243 are respectively configured at a distance from the centre of the circular plate 242 and spread around the periphery thereof, which enables supporting the seat cushion 30 and equal distribution of a person's weight thereon to achieve smooth rotation with no inclining of the seat cushion 30, thus extending the serviceable life of the rolling device 24.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A bathing seat structure for use in a bathtub, comprising:

a legs frame, which is assembled from a plurality of bars and placed within a bathtub or disposed to traverse a bathtub, the legs frame is fitted with two top cross bars, which are provided with a plurality of positioning holes, spring members and positioning plugs are disposed within each of the top cross bars, wherein the positioning plugs protrude external of the positioning holes;

a base, which comprises an upper plate and a lower plate, the lower plate is pin connected to the legs frame, and a bottom portion of the lower plate is provided with a plurality of pin connecting tubes that are mounted on an exterior of the top cross bars, wherein two front-end pin connecting tubes are respectively configured with a freeing mechanism; the upper plate is joined to a seat cushion, and a rolling device is fitted between the upper plate and the lower plate, the upper plate is provided with an upper through hole, and the lower plate is provided with a lower through hole; the upper plate is fitted with a lever, which is provided with a spring and a clasp post, wherein the clasp post inserts into the upper through hole and the lower through hole;

the seat cushion, which is joined to an upper plate of the base, and a bottom portion of the seat cushion is fixedly positioned with a bolt that enables mounting a spring thereon;

each of the freeing mechanisms comprises a press button, a spring, and a stud bolt, wherein the press button is provided with a press column, the spring is mounted on the press column, and the stud bolt combines internally with the press column; each of the pin connecting tubes is externally configured with a protruding body, which is internally provided with a through hole, and the through hole is internally provided with an inner push edge and an outer push edge;

the stud bolt is provided with a bolt head, the inner push edge stops the bolt head of the stud bolt when externally pushed thereon, and the outer push edge enables fixed positioning of a plug cap, which is internally provided with an inner push ring and an internal through hole, wherein the spring butts atop the inner push ring and the internal through hole enables the stud bolt to pass therethrough; pressing down on the press button connectively drives the stud bolt and the bolt head, whereupon the bolt head pushes atop and causes the positioning plug to retract from within the positioning hole, which is thus subjected to the natural restoring force of the spring;

the rolling device comprises a plurality of upper rollers, a circular plate, and a plurality of lower rollers, wherein the bottom surface of the upper plate is provided with a plurality of bottom positioning slots, and the upper rollers are disposed in the bottom positioning slots; the top surface of the lower plate is provided with a plurality of top positioning slots, and the lower rollers are disposed in the top positioning slots;

the circular plate is centrally pivot connected between the upper plate and the lower plate, and pulling the lever causes the clasp post to separate from the upper through hole; the base is internally provided with a two-tier configuration of the upper rollers and the lower rollers, wherein the upper rollers and the lower rollers are spread around the centre of the circular plate, thereby enabling smooth rotation on the lower plate of the base.

2. The bathing seat structure for use in a bathtub according to claim 1, wherein each of the top cross bars are provided with two stop external rings, and displacement of the pin connecting tubes of the lower plate is stopped by the stop external rings.

3. The bathing seat structure for use in a bathtub according to claim 1, wherein the lower portions on two sides of the seat cushion are each fitted with an armrest bar.

4. The bathing seat structure for use in a bathtub according to claim 1, wherein the lower portion on one side of the seat cushion is fitted with the single armrest bar.

5. The bathing seat structure for use in a bathtub according to claim 1, wherein the bathing seat is fitted with a pair of legs on each side of the legs frame.

6. The bathing seat structure for use in a bathtub according to claim 1, wherein the lower portion on one side of the seat cushion is fitted with the single armrest bar, the bathing seat is fitted with only a pair of legs on one side of the legs frame and a clamping device is fitted on the other side.

* * * * *